US012158268B2

(12) United States Patent
Fleifil et al.

(10) Patent No.: US 12,158,268 B2
(45) Date of Patent: Dec. 3, 2024

(54) HIGH-CAPACITY IGNITER

(71) Applicant: Forney Corporation, Addison, TX (US)

(72) Inventors: Mahmoud Fleifil, Addison, TX (US); Manmohan Singh, Addison, TX (US)

(73) Assignee: Forney Corporation, Addison, TX (US)

( * ) Notice: Subject to any disclaimer, the term of this patent is extended or adjusted under 35 U.S.C. 154(b) by 676 days.

(21) Appl. No.: 17/342,257

(22) Filed: Jun. 8, 2021

(65) Prior Publication Data

US 2022/0390108 A1 Dec. 8, 2022

(51) Int. Cl.

| | |
|---|---|
| ***F23N 1/02*** | (2006.01) |
| ***F23Q 3/00*** | (2006.01) |
| ***F23Q 9/00*** | (2006.01) |

(52) U.S. Cl.

CPC ..... *F23Q 9/00* (2013.01); *F23N 1/027* (2013.01); *F23Q 3/006* (2013.01); *F23N 2227/22* (2020.01); *F23N 2227/30* (2020.01); *F23N 2227/36* (2020.01)

(58) Field of Classification Search

CPC ... F23Q 9/00; F23Q 9/08; F23Q 13/02; F23N 1/027; F23N 2227/22; F23N 2227/30; F23N 2227/36; F23D 2207/00; F23D 2900/00014; F23D 2900/00015

USPC ..... 431/49, 278, 43

See application file for complete search history.

(56) References Cited

U.S. PATENT DOCUMENTS

| | | | | | |
|---|---|---|---|---|---|
| 2,869,631 | A | * | 1/1959 | Zink | F23Q 9/00 431/283 |
| 3,134,424 | A | | 5/1964 | Zink et al. | |
| 3,260,301 | A | * | 7/1966 | Zoschak et al. | F23D 14/26 431/263 |
| 3,741,483 | A | | 6/1973 | Kawaguchi | |
| 3,850,571 | A | * | 11/1974 | Zink | F23D 14/26 239/425.5 |
| 3,896,344 | A | | 7/1975 | Haselton | |
| 4,182,009 | A | | 1/1980 | Cooper et al. | |
| 4,298,333 | A | * | 11/1981 | Wunning | F23C 3/002 431/11 |
| 4,645,449 | A | * | 2/1987 | Schwartz | F23D 14/58 431/8 |
| 4,664,619 | A | | 5/1987 | Johnson et al. | |
| 5,055,032 | A | * | 10/1991 | Altemark | F23D 14/20 60/753 |
| 5,299,930 | A | | 4/1994 | Weidman | |

(Continued)

FOREIGN PATENT DOCUMENTS

| | | | | |
|---|---|---|---|---|
| CN | 110371927 A | * | 10/2019 | C01B 3/34 |
| FR | 2532405 A1 | * | 8/1982 | F23Q 3/008 |

(Continued)

*Primary Examiner* — Avinash A Savani

(74) *Attorney, Agent, or Firm* — DLA Piper LLP (US)

(57) ABSTRACT

An improved and high capacity gas igniter for furnaces and burners. The igniter can include an igniter tip that is annular in shape and includes various holes of different sizes and angular projections distributed throughout. The igniter tip may utilize a slip-joint-like mechanism or sleeve that connects inner and outer tubes of a guide tube that allows the inner tube to slide when undergoing thermal expansion. This configuration alleviates stress from building up on the inner tube and igniter tip, preventing damage.

13 Claims, 6 Drawing Sheets

(56) References Cited

U.S. PATENT DOCUMENTS

| | | | | |
|---|---|---|---|---|
| 7,299,620 | B2 | 11/2007 | Stuttaford et al. | |
| 8,070,483 | B2 | 12/2011 | Zalman | |
| 8,079,218 | B2 | 12/2011 | Widener | |
| 8,161,751 | B2 | 4/2012 | Hall | |
| 8,393,893 | B2 * | 3/2013 | Schroder | F23G 5/20 431/189 |
| 8,464,537 | B2 | 6/2013 | Khan et al. | |
| 8,920,159 | B2 * | 12/2014 | Taylor | F23C 9/003 431/278 |
| 9,074,764 | B2 | 7/2015 | Hull et al. | |
| 9,643,871 | B2 | 5/2017 | Cowles et al. | |
| 9,822,967 | B2 | 11/2017 | Taylor | |
| 10,101,028 | B2 | 10/2018 | Loveless et al. | |
| 10,591,156 | B2 | 3/2020 | Kiyama et al. | |
| 10,718,512 | B2 | 7/2020 | Dorval et al. | |
| 10,844,293 | B2 * | 11/2020 | Cook | F23D 14/02 |
| 11,041,621 | B2 * | 6/2021 | Ozawa | F27D 7/02 |
| 11,306,915 | B2 * | 4/2022 | Sano | F23D 1/02 |
| 2007/0003897 | A1 | 1/2007 | Koizumi et al. | |
| 2007/0137171 | A1 * | 6/2007 | Chapin | F23R 7/00 60/749 |
| 2009/0224208 | A1 | 9/2009 | Wodberg et al. | |
| 2011/0247340 | A1 | 10/2011 | Popovic et al. | |
| 2013/0019584 | A1 | 1/2013 | Koizumi et al. | |
| 2013/0260326 | A1 | 10/2013 | Gonvalves et al. | |
| 2014/0283524 | A1 * | 9/2014 | Li | F23R 3/36 60/776 |
| 2015/0050605 | A1 * | 2/2015 | Desi-Seulean | F23D 14/36 431/185 |
| 2015/0226431 | A1 * | 8/2015 | Ristic | F23Q 3/00 431/258 |
| 2016/0025336 | A1 * | 1/2016 | Lang | F23G 7/085 431/354 |
| 2017/0234219 | A1 | 8/2017 | Barve et al. | |
| 2019/0346140 | A1 | 11/2019 | Kiener et al. | |
| 2020/0300461 | A1 | 9/2020 | Kattelus et al. | |

FOREIGN PATENT DOCUMENTS

| | | | | |
|---|---|---|---|---|
| IN | 20170413161 | | 10/2017 | |
| JP | 58145825 A | * | 2/1982 | F23Q 9/00 |
| WO | WO 20174/018992 | | 2/2017 | |

* cited by examiner

HIGH-CAPACITY IGNITER

BACKGROUND OF THE DISCLOSURE

Furnaces are a major component of many central heating systems that are used to heat large interior spaces, such as houses and other buildings, and to provide heat in industrial applications. Furnaces are also used in utility and chemical industries to provide heat for steam generation and to facilitate the generation of chemical products. The typical operation of a furnace includes the burning of fuel and the resulting movement of an intermediary substance (e.g., air, steam, hot water, etc.) to disperse heat throughout the boilers or to specific areas for work (e.g., applying heat for metallurgy purposes and chemical processing). Fuel sources can include natural gas, liquefied petroleum gas, oil, wood, and coal, among others.

Many types of furnaces utilize a burner to burn the aforementioned fuels to provide heat. However, some burners, such as coal-fired burners, cannot be lit by themselves and rely on an igniter to provide ignition of the fuel. As long as a sufficient amount (depending on the size of the furnace and other relevant specifications) of air is provided and maintained, the fire within the burner is maintained, and thus operation of the furnace is maintained. Because of the popularity of number 2 oil in the U.S., oil-fired burners have historically been employed in furnaces and were generally rated between at about 3-10% of burner capacity. Burner capacity is the capability of the burner to generate heat and is typically measured in MBTU/hr (mega British thermal unit per hour); a normal burner capacity is around fifty to two hundred fifty MBTU/hr. In addition, oil-fired burners require a fairly high temperature to maintain burning, which necessitated large amounts of energy. As natural gas became cheaper and more readily available for mass use, gas burners began to overtake oil burners.

However, because both gas from external gas lines and external air (i.e., "combustion air," as described herein) are needed for combustion, gas igniters can be quite expensive. In addition, especially in the case of use in buildings with limited space (e.g., older buildings), there can be significant physical constraints on how much combustion air can be accessed. For example, in older coal and oil burners, the internals of these burners pose a physical limitation on the size of the igniter that can be used. This can limit the cost and efficiency of these burners.

SUMMARY OF THE DISCLOSURE

In one embodiment, a furnace igniter system is provided. The system comprises a guide tube comprising an end to be positioned within a furnace; the guide tube is configured to receive gas from a gas inlet and air from an air inlet and provide the gas and air to the furnace; and an igniter tip connected to the end of the guide tube to be positioned within the furnace. The igniter tip comprises first and second sets of holes, holes of the first set of holes having a size and orientation different than a size and orientation of holes of the second set of holes, the first and second set of holes being configured to provide the gas to the furnace.

DESCRIPTION

Figure 1:
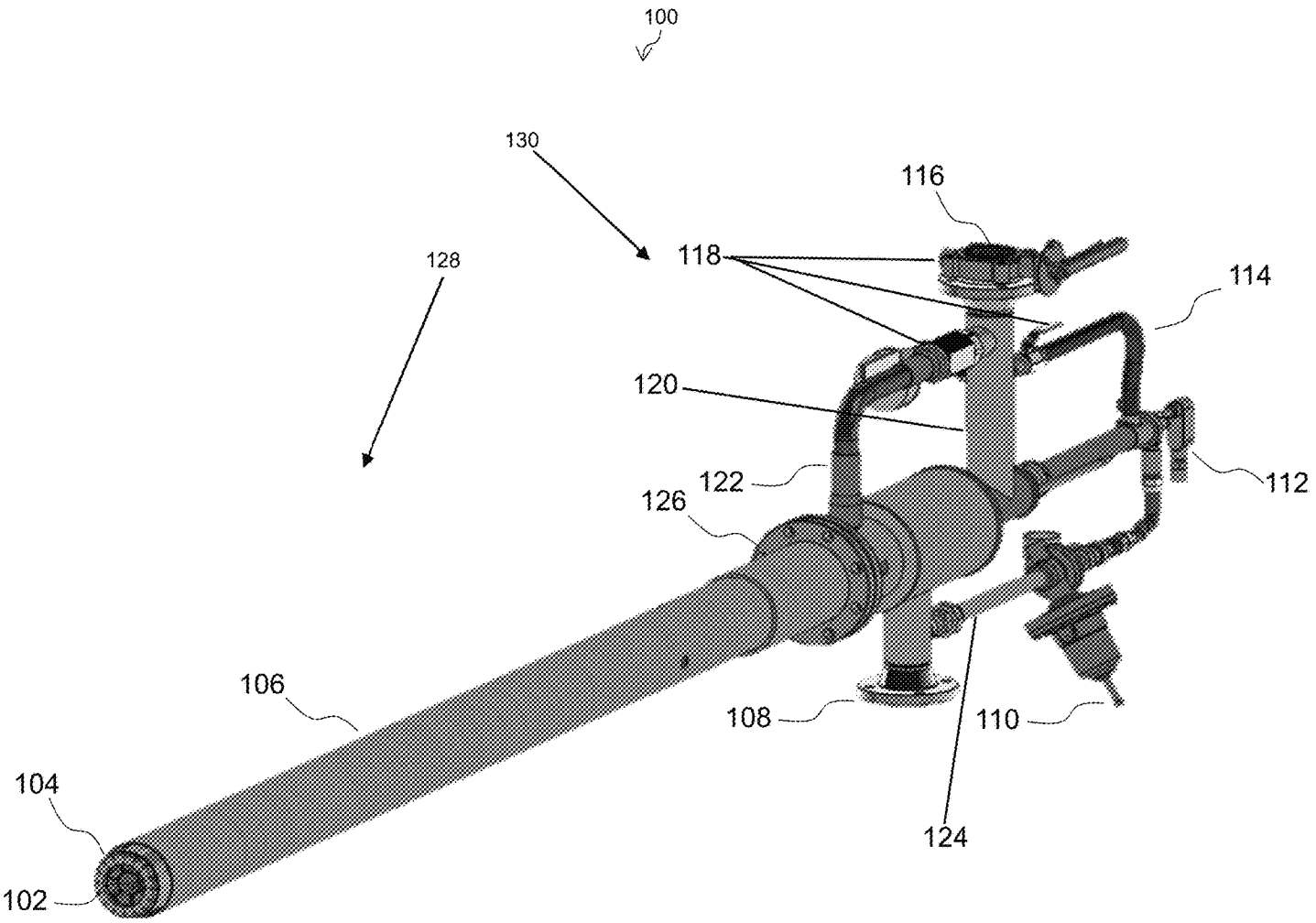
FIG. 1 is a high capacity igniter according to some embodiments of the present disclosure.

The following detailed description is merely exemplary in nature and is not intended to limit the invention or the applications of its use.

Embodiments of the present disclosure relate to an improved and high capacity gas igniter for furnaces and burners. The disclosed igniter can include an igniter tip that is annular in shape (i.e., ring-like), which includes various holes of different sizes and angular projections distributed throughout. Typically, igniter tips are not annular and do not include holes of different sizes or angular projections. Combustion via standard igniters relies on pumping air and fuel (external combustion air or air from outside the furnace) to a pilot at the end of an igniter tip. The disclosed igniter tip, because of its annularity and hole design, can be uniquely connected to the gas line used by the burner and pilot. The disclosed holes cause radial gas dispersion, which increases mixing with the surrounding air (e.g., internal combustion air or air from inside the furnace). Increased mixing can cause more robust and reliable combustion. The holes in the igniter tip can be in a variety of configurations and patterns and are described in more detail with respect to FIG. 4. Because the disclosed igniter tip allows for a greater dependence on internal combustion air during ignition, significantly less air must be pumped or blown in from external sources. In other words, the disclosed igniter has a lesser dependence on external combustion air. This provides more robust and reliable ignition and allows burners or furnaces that employ such an igniter to be used in confined spaces.

In addition, embodiments of the present disclosure relate to a safety-mechanism that can prevent damage to igniters and igniter tips. Because of the extreme conditions at the inside of a furnace, igniters can often fail and/or break when the igniter tip breaks off from the igniter. Many igniters include concentric tubes, such as an outer and an inner tube. The tubes are often welded together, and the igniter tip is welded or attached at the end. The outer tube is in direct contact with the furnace air, which can reach temperatures up to 650° F., while the inner tube is usually at a much lower temperature because of the gas it transports. In some cases, such as during the winter, the transported gas and inner tube can be as low as 25-30° F. This difference in temperature can cause the outer tube to undergo higher degrees of thermal expansion than the inner tube. Because of such non-uniform expansion, significant stresses can be put on the igniter tip, which can detach from the system and potentially cause explosions and other damage. In one or more embodiments, the igniter tip disclosed herein utilizes a slip-joint-like mechanism or sleeve that connects the inner and outer tubes; this allows the inner tube to slide when undergoing thermal expansion, which alleviates stress from building up on the inner tube and igniter tip, preventing damage. In addition, the sleeve can employ Labyrinth teeth to control leakage from the slip-joint. This is a major improvement over existing ignitor systems.

Accordingly, as will become apparent, the disclosed igniter offers various advantages, such as a diminished physical footprint, high turn-down capability, improved reliability in ignition in both cold and hot boilers, increased flame stability, a reduced requirement in terms of combustion air and cooling air, and greater robustness against damage.

FIG. 1 is a high capacity igniter 100 according to some embodiments of the present disclosure. In some embodiments, igniter 100 can be installed on a furnace wall via tube 126 (wall not shown). When installed, a first portion 128 of igniter 100 (i.e., the portion to the left of tube 126 in the illustrated embodiment) would be positioned such that the igniter 100 can ignite the burner, while a second portion 130 of igniter 100 (i.e., the portion to the right of tube 126 in the illustrated embodiment) would be positioned on the other side of the furnace wall. The first portion 128 of igniter 100 can include a pilot 102, igniter tip 104, and a guide tube 106. In some embodiments, the guide tube 106 can include concentric tubes; additional details with respect to the guide tube 106 are discussed below with respect to FIGS. 4-6. In some embodiments, the guide tube 106 can be approximately ten feet in length. The pilot 102 can be any pilot used in furnaces (e.g., a small burner that is consistently kept lit). In accordance with the disclosed principles, igniter tip 104 can be annular in shape and can include various configurations of holes as described below with respect to FIGS. 2-4.

The second portion 130 of igniter 100 can include a common gas inlet 108, pilot gas regulator 110, spark rod 112, pilot air branch 114, common air inlet 116, various manual valves 118, a primary air source 120, a secondary air branch 122, and a pilot gas branch 124. During operation, a fraction of the gas from the common gas inlet 108 can be controlled by the pilot gas branch 124 and pilot gas regulator 110 and sent to a protective environment to create a small stable flame (e.g., pilot 102). In some embodiments, the common gas inlet 108 can provide gas at around five to twenty pounds per square inch (PSI). In some embodiments, the pilot gas regulator 110 can be set at two PSI. The pilot 102 can be ignited by the spark rod 112. In some embodiments, the pilot 102 can be continuously lit to ignite and stabilize the main flame of the igniter. A continuously lit pilot 102 can enable a high turndown capability, between around fifteen to fifty MBTU/hr. In some embodiments, the turndown ratio (i.e., the ratio of minimum load to maximum load) can be around 1:3 to 1:4, whereas many igniters have zero turndown ratio.

In some embodiments, a majority of the gas from the common gas inlet 108 can be sent to igniter tip 104, which is configured to provide a flame for ignition of the furnace. In some embodiments, combustion air is provided by the common air inlet 116, and the manual valves 118 can split the combustion air into primary and secondary combustion air (e.g., primary air source 120 and secondary air branch 122). In some embodiments, the common air inlet 116 can have a diameter of around three inches. The primary combustion air is provided to igniter tip 104. Pilot air branch 114 can provide air from the common air inlet 116 to the pilot 102. In some embodiments, igniter tip 104 and pilot 102 together can use about 240 standard cubic feet per minute (SCFM) of combustion air for ignition. The primary combustion air exits igniter tip 104 through an annular area between the igniter inner wall and the pilot 102 to create a flammable mixture of air and fuel at the core of the main flame.

Secondary combustion air is routed through secondary air branch 122 and provided at a different point to igniter 104. Air can be routed directly from the burner wind box and used as both secondary combustion air and tertiary combustion air. In some embodiments, secondary combustion air can include both air from the burner wind box and air from the common air inlet 116 that is routed through secondary air branch 122. A burner wind box is a part of the furnace that provides combustion air to the burner and is not shown in the figures. Additional details on the secondary and tertiary combustion air flows are discussed below with respect to FIG. 6. In addition, igniter tip 104 can include a controlled leak sliding mechanism to avoid stress caused by differential thermal expansion between tubes within the guide tube 106 (see FIGS. 5A and 5B).

Figure 2:
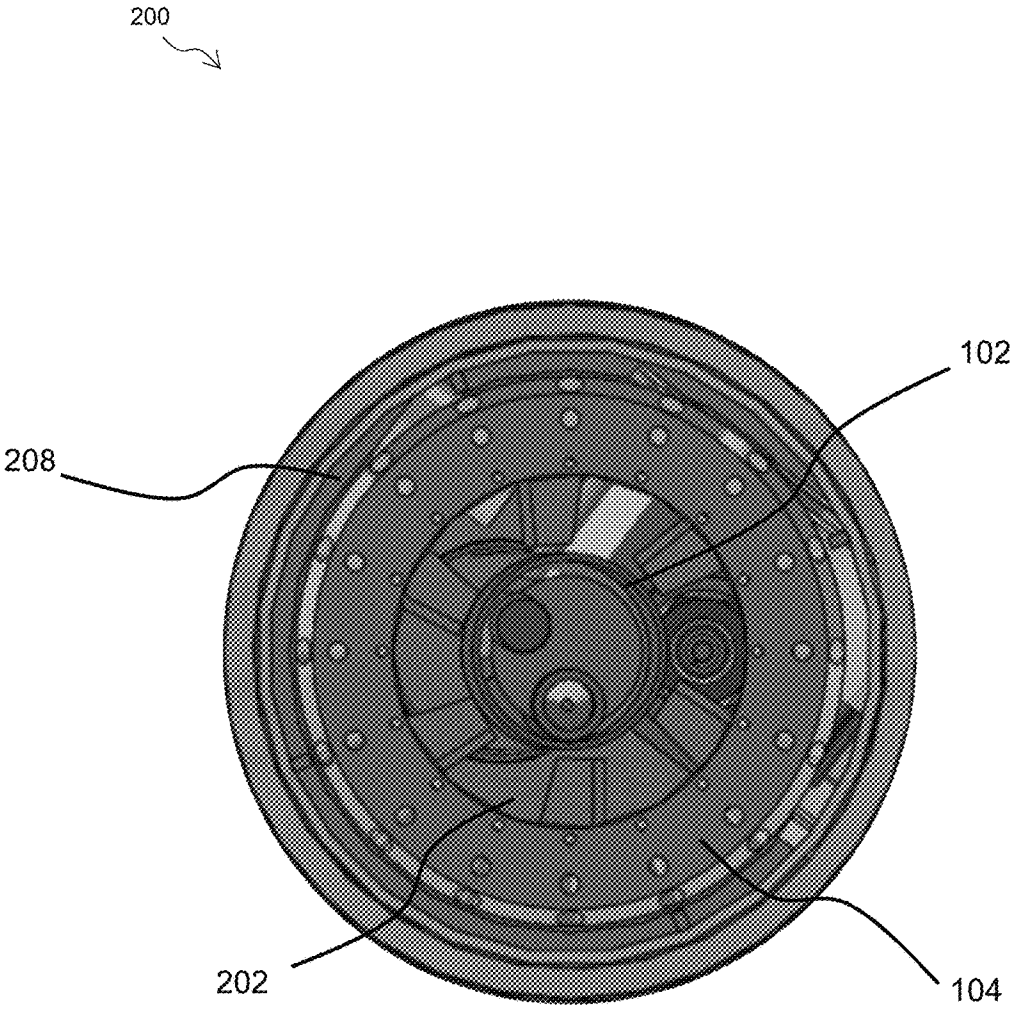
FIG. 2 is an example hot end of the igniter of FIG. 1 according to some embodiments of the present disclosure.

FIG. 2 is an example hot end 200 of the igniter 100 of FIG. 1 according to some embodiments of the present disclosure. The cross-sectional view of the hot end 200 shows pilot 102 and igniter tip 104. Additional details of the pilot 102 are described below with respect to FIG. 3. Igniter tip 104 is annular shaped and includes a plurality of holes (the holes are described in more detail with respect to FIG. 4). In addition, hot end 200 shows the different routes through the guide tube 106 that the various segments of combustion air take. For example, cross-sectional area 202 can receive primary combustion air for ignition, such as from primary air source 120. In addition, cross-sectional area 208 can receive secondary combustion air that includes air from one or both of the burner wind box and the secondary air branch 122.

Figure 3:
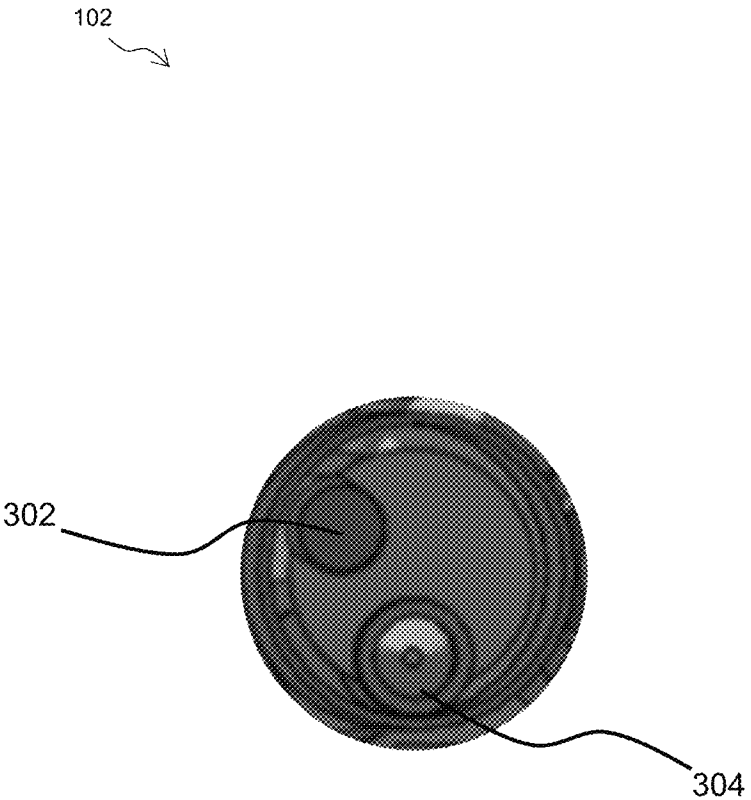
FIG. 3 is an example pilot that can be used within the devices of FIGS. 1 and 2 according to some embodiments of the present disclosure.

FIG. 3 is an example pilot 102 that can be used within the devices of FIGS. 1 and 2 according to some embodiments of the present disclosure. In the illustrated example, the pilot 102 includes a spark rod tip 302, which can be connected to the spark rod 112 of FIG. 1 via guide tube 106. In addition, pilot 102 can include a pilot gas pipe 304. The pilot gas pipe 304 can receive gas from the common gas inlet 108 that is controlled by pilot gas branch 124 and pilot gas regulator 110 and provide the gas near the spark rod tip 302 for ignition and burning of the pilot flame. In some embodiments, the pilot fuel rate range can be between about 0.25 and one MB TU/hr.

Figure 4:
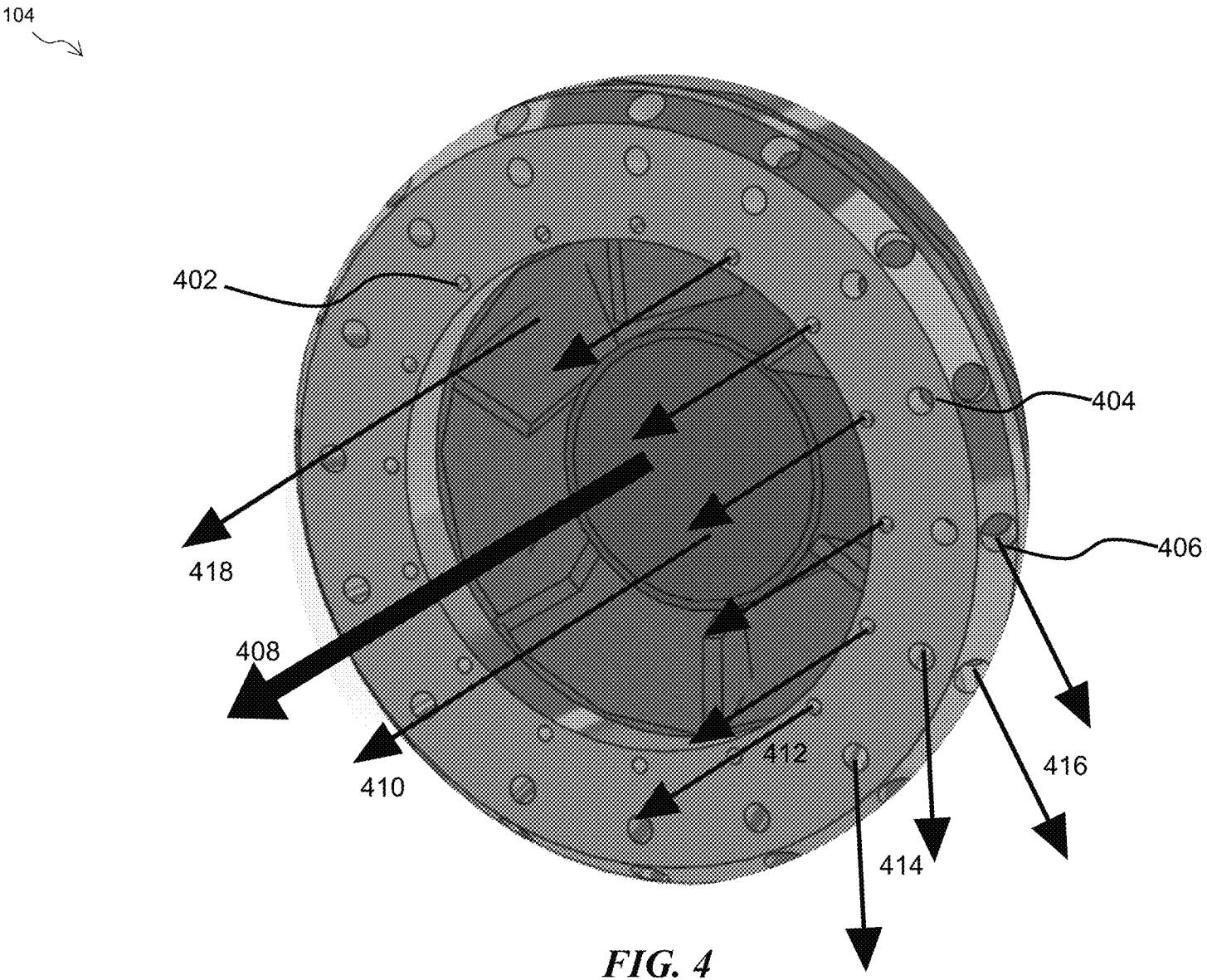
FIG. 4 is an example igniter tip according to some embodiments of the present disclosure.

FIG. 4 is an example igniter tip 104 according to some embodiments of the present disclosure. As described above, in one or more embodiments, igniter tip 104 is annular or ring-shaped. In accordance with the disclosed principles, igniter tip 104 includes a configuration of holes to cause radial gas dispersion within the furnace, which increases mixing with the surrounding air (e.g., internal combustion air or air from inside the furnace). Such increased mixing will cause more robust and reliable combustion. In the illustrated example, igniter tip 104 includes a first set of holes 402, a second set of holes 404, and a third set of holes 406. Each set of holes can be configured to project jets of fuel at different angles as shown by their respective arrows in FIG. 4. In addition, the holes 402-406 can have gradually increasing radii and orientations. For example, the first set of holes 402 can have a diameter of between about zero and 0.15 inches and can be oriented at an angle of between about five and fifteen degrees. The second set of holes 404 can have a diameter of between about 0.15 and 0.225 inches and can be oriented at an angle of between about ten and thirty degrees. The third set of holes 406 can have a diameter of between about 0.2 and 0.3 inches and can be oriented at an angle of between about twenty-five to fifty degrees. In some embodiments, there can be between about twelve and twenty holes in each set of holes 402, 404, 406. In some embodiments, the holes 402, 404, 406 within each set can be evenly spaced about the respective circumferences of igniter tip 104.

The holes 402, 404, 406 can be configured to project gas outward in the various directions to increase mixing between the combustion air and the fuel (e.g., the gas). Arrow 408 illustrates the flow of pilot air (e.g., from pilot air branch 114), while arrow 410 illustrates the flow of pilot gas (e.g., from pilot gas branch 124). Arrows 412 illustrate the flow of gas directed outward within the furnace from holes 402; arrows 414 illustrate the flow of gas directed outward within the furnace from holes 404; and arrows 416 illustrate the flow of gas directed outward within the furnace from holes 406. Arrow 418 illustrates the flow of primary combustion air in the annular area between the pilot 102 and the outer tube (not shown).

Figure 5B:
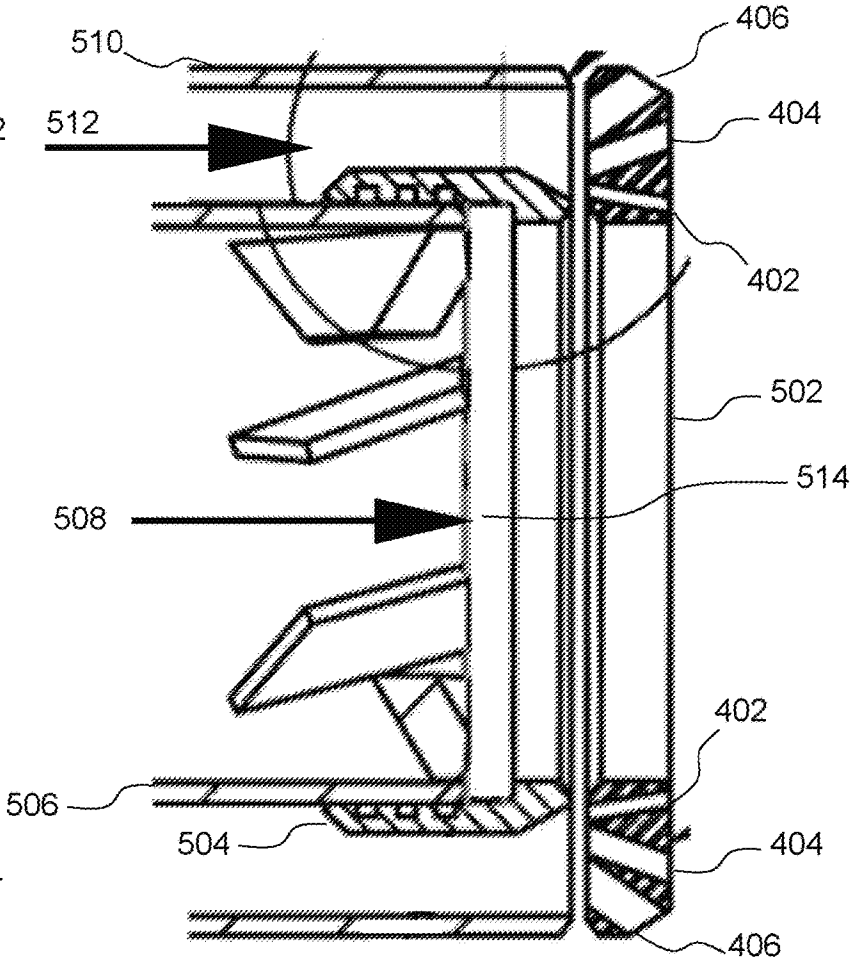
FIGS. 5A and 5B show an example sleeve arrangement of the high capacity igniter of FIG. 1 according to some embodiments of the present disclosure.
Figure 5A:
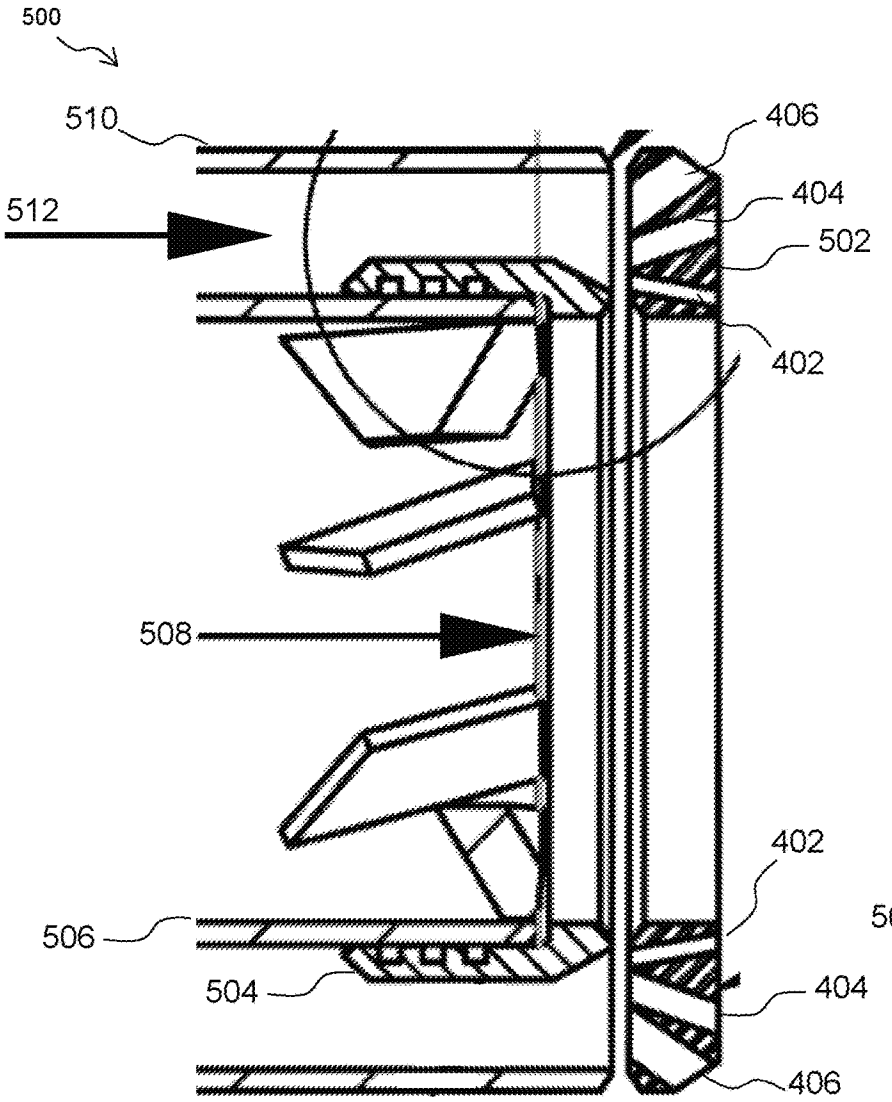

FIGS. 5A and 5B show an example sleeve arrangement 500 of the high capacity igniter of FIG. 1 according to some embodiments of the present disclosure. FIG. 5A shows the sleeve arrangement 500 in a cold condition, or any condition in which the differential thermal expansion between the inner tube 506 and the outer tube 510 is relatively low. Sleeve arrangement 500 can be an arrangement of an igniter tip at the end of a guide tube, such as igniter tip 104 and guide tube 106 of FIG. 1. Sleeve arrangement 500 includes igniter tip 104, which is attached to outer tube 510. The arrangement also includes an inner tube 506. Arrow 508 illustrates the flow of primary combustion air (e.g., see arrow 418 of FIG. 4) within inner tube 506. Arrow 512 illustrates the flow of main tip gas, which is projected outwards within the furnace by holes 402-406 in order to enhance combustion. Additionally, inner tube 506 and outer tube 510 are connected via a sleeve 504. In some embodiments, sleeve 504 can include a slip joint-like feature and can be made of grade 310 stainless steel. Sleeve 504 is configured to allow the inner tube 506 to slide left and right. Such sliding can compensate for differential thermal expansion between the inner tube 506 and the outer tube 510. For example, the outer tube 510 will often be exposed to high temperature within the furnace (up to 650° F. or more), while the inner tube 506 may often experience lower temperature because of the less direct exposure to the internal furnace environment and because tube 506 transports gas. The gas can sometimes be as low as 30° F. in the winter. Therefore, the outer tube 510 will undergo greater thermal expansion and expand by a greater amount than the inner tube 506. When this happens, the inner tube 506 can slide within the sleeve 504. If the sleeve 504 were not there, the expansion of outer tube 510 would put stress directly onto the inner tube 506 and igniter tip 502.

FIG. 5B shows the sleeve arrangement 500 in a hot condition, or a condition in which the differential thermal expansion between the inner tube 506 and the outer tube 510 is relatively high. As discussed above, when the outer tube 510 is at a significantly higher temperature than the inner tube 506 (e.g., because it is directly exposed to the inner furnace environment), it will expand more than the inner tube 506 expands. The sleeve 504 ensures that such expansion can occur without damage to the igniter tip 104 or any other components by allowing the outer tube 510 to slide. The sliding via the sleeve 504 creates a gap 514 between the ends of the inner tube 506 and the outer tube 510. Because the outer tube 510 has freedom to move laterally when it thermally expands, stress on the inner tube 506 is alleviated. Without the sleeve 504, the gap 514 would not exist and all of the stress from the thermal expansion of the outer tube 510 would be exerted on to the inner tube 506 and the igniter tip 104. Thus, the sleeve arrangement 500 helps to alleviate stress buildup on components of the igniter.

Figure 6:
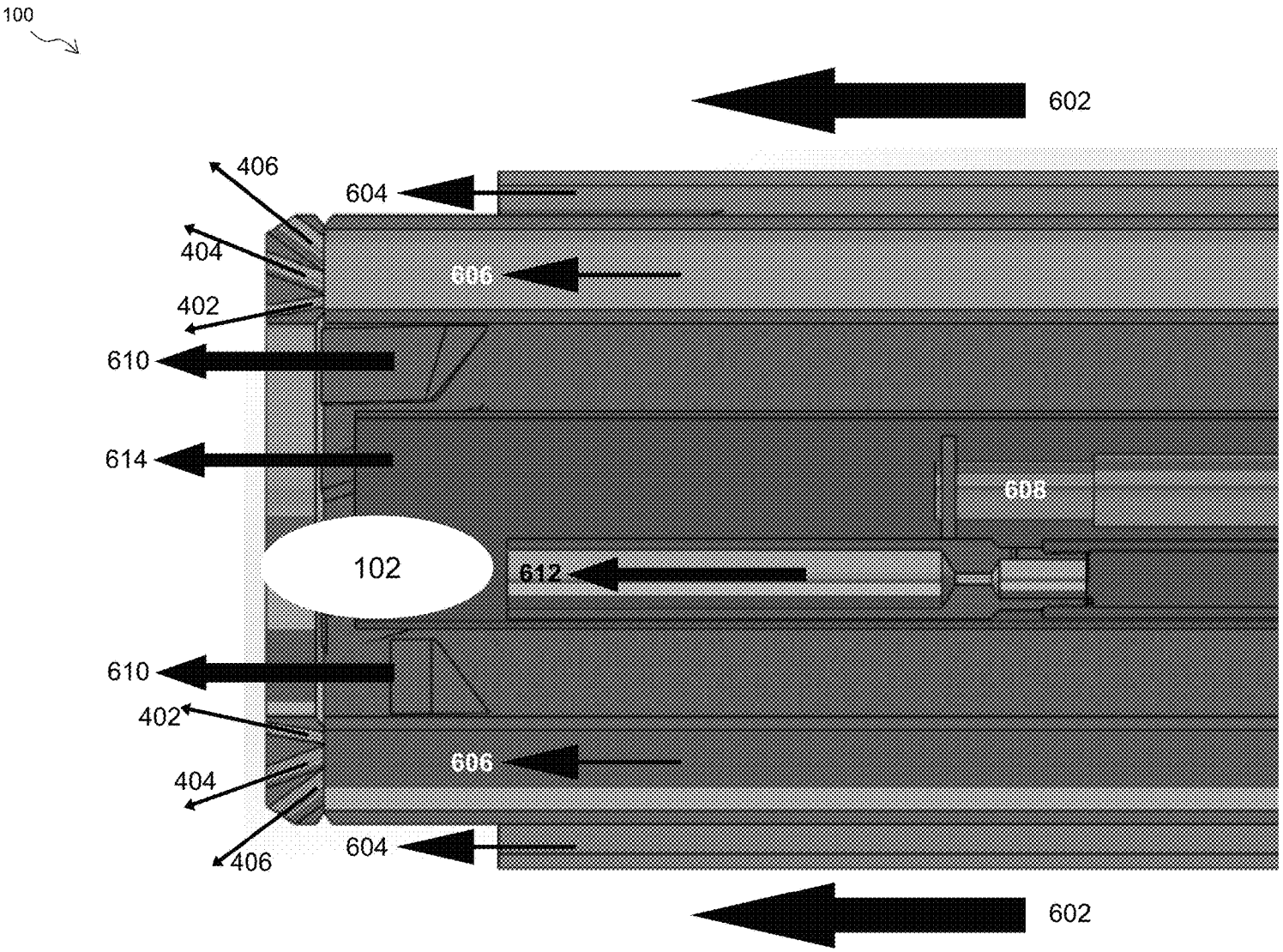
FIG. 6 is a cross-sectional view illustrating gas and air pathways of the high capacity igniter of FIG. 1 according to some embodiments of the present disclosure.

FIG. 6 is a cross-sectional view illustrating gas and air pathways of the high capacity igniter 100 of FIG. 1 according to some embodiments of the present disclosure. For example, FIG. 6 can be a cross-sectional view of guide tube 106 within the igniter 100. Arrows 602 illustrate the flow of tertiary combustion air, which comes from the burner wind box through a burner barrel (not shown) around the guide tube 106 on the outside of outer tube 510; arrows 604 illustrate the flow of secondary combustion air. The secondary and tertiary combustion air can originate from the burner wind box. Arrows 606 illustrate the flow of main tip gas, which is projected outwards within a furnace by holes 402-406. The flow of the main tip gas can be between the inner tube and outer tube, such as described in FIGS. 5A and 5B. As described in FIG. 4, the holes 402-406 can include different radii (e.g., gradually increasing radii) and can be oriented at different angles to facilitate and enhance mixing of combustion air and gas within the furnace to improve combustion. Igniter 100 also includes a flow of pilot gas, as indicated by arrow 612, and a flow of pilot air, as indicated by arrow 614, which can be ignited to maintain a pilot flame 102 via spark rod 608. The flow of primary combustion air is illustrated by arrow 610; the primary combustion air exits the igniter 100 through an annular area between the inner wall of the inner tube (see inner tube 506 of FIGS. 5A and 5B) and the pilot to create a flammable mixture at the core of a main flame (not shown). The design of igniter 100 allows a single fuel supply line to be utilized by both the igniter and the pilot (e.g., common gas inlet 108 of FIG. 1).

The disclosed high capacity igniter can fire up to 50 MBTU/hr of natural gas through a small guide tube (around six inches in diameter) with one gas supply line and one common air inlet. A small fraction of the gas is taken from the gas supply line, controlled, and sent to a protective environment to create a small, stable flame, which acts as a pilot for the main igniter. The pilot flame can be ignited by a high energy spark rod. The continuously lit pilot ignites and stabilizes the igniter main flame at all times. A continuously lit pilot flame enables a high turndown capability (fifteen to fifty MBTU/hr).

A majority of the gas is sent to the main igniter tip, which has multiple holes with different sizes and projection angles to ensure good mixing with the air and thus a stable igniter flame. The combustion/cooling air is split between the pilot and the main igniter, and the split ratio is controlled via manual valves. The igniter needs only 240 SCFM of combustion/cooling air for both the pilot and the igniter primary combustion air. Secondary and tertiary combustion air are taken directly from the burner wind box. Some of the secondary combustion air can be taken from the primary combustion/cooling air and is controlled via a manual valve. The primary combustion air exits the igniter through an annular area between the igniter inner wall and the pilot to create a flammable mixture of gas and fuel at the core of the main flame. The igniter tip has a unique controlled-leak sliding mechanism to avoid stress due to differential thermal expansion between the inner and outer tube delivering gas to the igniter tip.

While various embodiments have been described above, it should be understood that they have been presented by way of example and not limitation. It will be apparent to persons skilled in the relevant art(s) that various changes in form and detail may be made therein without departing from the spirit and scope. In fact, after reading the above description, it will be apparent to one skilled in the relevant art(s) how to implement alternative embodiments. For example, other steps may be provided, or steps may be eliminated, from the described flows, and other components may be added to, or removed from, the described systems. Accordingly, other implementations are within the scope of the following claims.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A furnace igniter system comprising:

a guide tube comprising an end to be positioned within a furnace, the guide tube is configured to receive gas from a gas inlet and air from an air inlet and provide the gas and air to the furnace; and an igniter tip connected to the end of the guide tube and to be positioned within the furnace, the igniter tip comprising first and second sets of holes, holes of the first set of holes having a size and orientation different than a size and orientation of holes of the second set of holes, the first and second set of holes being configured to provide the gas to the furnace;

wherein the igniter tip further comprises a third set of holes configured to provide the gas to the furnace, holes of the third set of holes having a size and orientation different than the size and orientation of the holes of the first and second set of holes;

where the first, second, and third sets of holes each comprise a plurality of holes;

wherein the first set of holes is oriented to provide the gas to the furnace at a first angle relative to an axis of the guide tube;

the second set of holes is oriented to provide the gas to the furnace at a second angle relative to the axis of the guide tube; and the third set of holes is oriented to provide the gas to the furnace at a third angle relative to the axis of the guide tube;

wherein the first angle is between about five and fifteen degrees;

the second angle is between about ten and thirty degrees; and the third angle is between about twenty-five to fifty degrees.

2. The furnace igniter system of claim 1, wherein the igniter tip is annular in shape.

3. The furnace igniter system of claim 1, wherein:

the first set of holes is positioned circumferentially at a first radius from a center of the igniter tip;

the second set of holes is positioned circumferentially at a second radius from the center of the igniter tip; and the third set of holes is positioned circumferentially at a third radius from the center of the igniter tip, wherein the third radius is greater than the second radius and the second radius is greater than the first radius.

4. The furnace igniter system of claim 3, wherein the holes of each of the first, second, and third set of holes are evenly spaced around the igniter tip.

5. The furnace igniter system of claim 1, wherein the guide tube further comprises:

an inner tube;

an outer tube; and a slip-joint sleeve connecting the inner tube and outer tube at the end to be positioned within the furnace.

6. The furnace igniter system of claim 5, wherein the slip-joint sleeve comprises grade 310 stainless steel.

7. A furnace igniter system comprising:

a guide tube comprising an end to be positioned within a furnace, the guide tube is configured to receive gas from a gas inlet and air from an air inlet and provide the gas and air to the furnace, the guide tube comprising an inner tube, an outer tube, and a slip-joint sleeve connecting the inner tube and outer tube at the end to be positioned within the furnace; and an igniter tip connected to the end of the guide tube and to be positioned within the furnace, the igniter tip comprising first, second, and third sets of holes, holes of the first set of holes having a size and orientation different than a size and orientation of holes of the second set of holes, holes of the third set of holes having a size and orientation different than the size and orientation of the holes of the first and second set of holes, the first, second, and third set of holes being configured to provide the gas to the furnace.

8. The furnace igniter system of claim 7, wherein the igniter tip is annular in shape.

9. The furnace igniter system of claim 8, wherein:

the first set of holes is positioned circumferentially at a first radius from a center of the igniter tip;

the second set of holes is positioned circumferentially at a second radius from the center of the igniter tip; and the third set of holes is positioned circumferentially at a third radius from the center of the igniter tip, wherein the third radius is greater than the second radius and the second radius is greater than the first radius.

10. The furnace igniter system of claim 9, wherein the holes of each of the first, second, and third set of holes are evenly spaced around the igniter tip.

11. The furnace igniter system of claim 10, wherein:

the first set of holes is oriented to provide the gas to the furnace at a first angle relative to an axis of the guide tube;

the second set of holes is oriented to provide the gas to the furnace at a second angle relative to the axis of the guide tube; and the third set of holes is oriented to provide the gas to the furnace at a third angle relative to the axis of the guide tube.

12. The furnace igniter system of claim 11, wherein:

the first angle is between about five and fifteen degrees;

the second angle is between about ten and thirty degrees; and the third angle is between about twenty-five to fifty degrees.

13. The furnace igniter system of claim 7, wherein the slip-joint sleeve comprises grade 310 stainless steel.

* * * * *